US008875458B2

(12) United States Patent
Fritschi

(10) Patent No.: US 8,875,458 B2
(45) Date of Patent: Nov. 4, 2014

(54) MOLDING ARRANGEMENT AND METHOD FOR CREATING A RECESS WHEN CASTING A PART

(75) Inventor: Hubert Fritschi, Baden-Baden (DE)

(73) Assignee: Schock Bauteile GmbH, Baden-Baden (DE)

( * ) Notice: Subject to any disclaimer, the term of this patent is extended or adjusted under 35 U.S.C. 154(b) by 0 days.

(21) Appl. No.: 13/182,635

(22) Filed: Jul. 14, 2011

(65) Prior Publication Data

US 2012/0174528 A1 Jul. 12, 2012

(30) Foreign Application Priority Data

Jul. 19, 2010 (DE) ..... 10 2010 027 661

(51) Int. Cl.
*E04B 1/38* (2006.01)
*E04B 1/00* (2006.01)
*E04C 5/16* (2006.01)

(52) U.S. Cl.
CPC ..... *E04B 1/0038* (2013.01); *E04B 1/003* (2013.01); *E04C 5/168* (2013.01)
USPC ..... 52/259; 52/576; 52/583.1

(58) Field of Classification Search
USPC ..... 52/250, 259, 236.8, 236.9, 583.1, 576, 52/125.5
See application file for complete search history.

(56) References Cited

U.S. PATENT DOCUMENTS

| | | | | |
|---|---|---|---|---|
| 3,867,805 | A * | 2/1975 | Mikami et al. | 52/742.15 |
| 4,104,844 | A * | 8/1978 | Brownlee | 52/742.15 |
| 4,749,170 | A * | 6/1988 | Ase | 264/256 |
| 4,959,940 | A * | 10/1990 | Witschi | 52/583.1 |
| 5,366,672 | A * | 11/1994 | Albrigo et al. | 264/35 |
| 6,460,824 | B1 * | 10/2002 | Lancelot et al. | 249/91 |
| 7,003,921 | B2 * | 2/2006 | Hisano | 52/223.9 |
| 7,137,609 | B2 * | 11/2006 | Sack | 249/91 |
| 2004/0068944 | A1 * | 4/2004 | Dalton | 52/236.9 |
| 2010/0132292 | A1 * | 6/2010 | Gullette | 52/378 |

FOREIGN PATENT DOCUMENTS

| | | | |
|---|---|---|---|
| DE | 4302682 | A1 | 8/1994 |
| DE | 19528130 | B4 | 1/1997 |
| DE | 29614733 | U1 | 12/1997 |
| EP | 1101883 | A1 | 5/2001 |
| EP | 1126092 | | 8/2001 |

* cited by examiner

*Primary Examiner* — Brian Glessner
*Assistant Examiner* — Adam Barlow
(74) *Attorney, Agent, or Firm* — Volpe and Koenig, P.C.

(57) ABSTRACT

A molding arrangement for creating a recess when casting a building part for connecting the tensile reinforcement element to the building part, with the molding arrangement including at least one molding element (2) to form the recess (5) as well as at least one anchoring element (3) for the creation of a form-fitting connection between the building part and a filler material to be introduced into the recess. Additionally the invention provides a building element for thermal insulation between two building parts having the molding arrangement. And finally a method is disclosed to connect a reinforcement element to a building part.

15 Claims, 3 Drawing Sheets

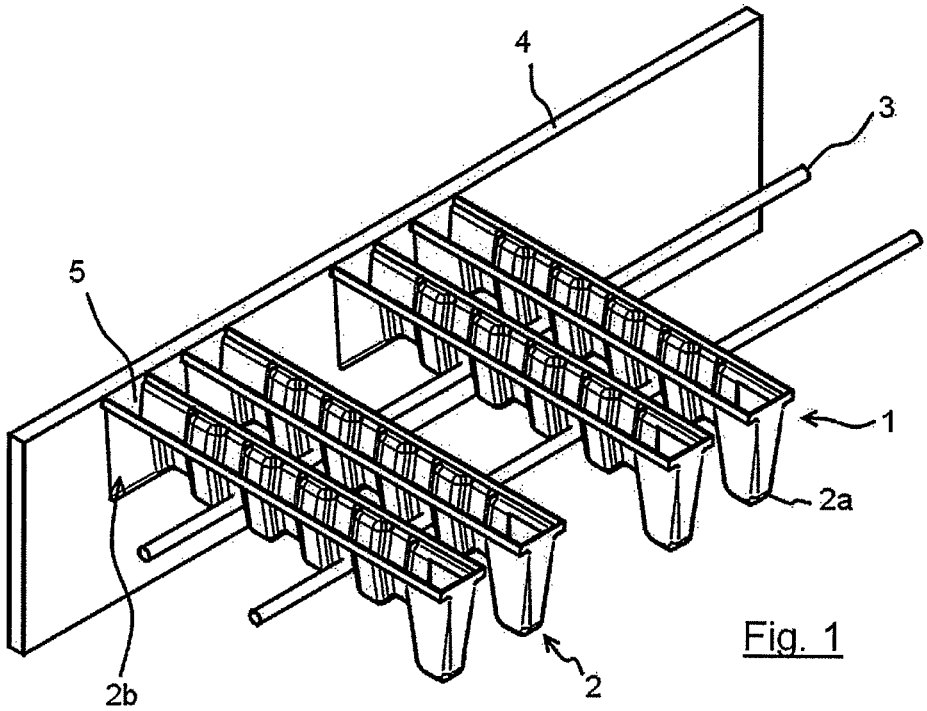
Fig. 1
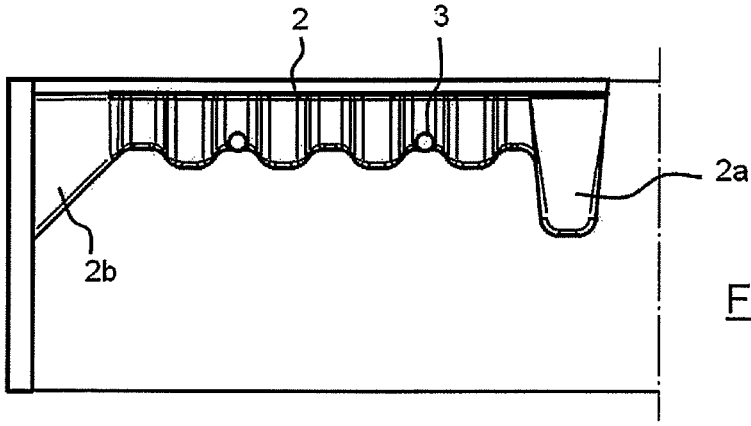
Fig. 2
Fig. 3
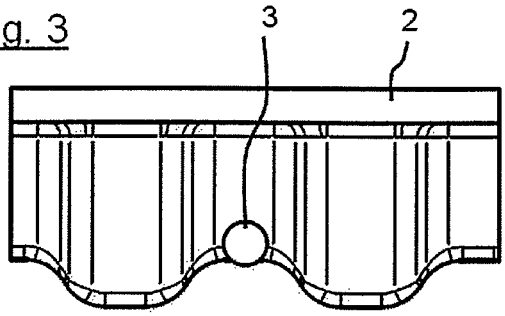
Fig. 4
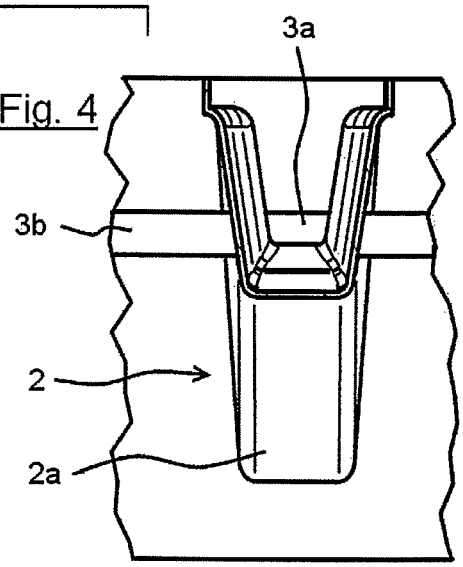

MOLDING ARRANGEMENT AND METHOD FOR CREATING A RECESS WHEN CASTING A PART

CROSS-REFERENCE TO RELATED APPLICATIONS

This application claims the benefit of German Patent Application No. 102010027661.8, filed Jul. 19, 2010, which is incorporated herein by reference as if fully set forth.

BACKGROUND

The present invention relates to a molding arrangement for creating a recess when casting a part, in particular a building ceiling to be made from in-situ concrete, for connecting a particularly rod-shaped tensile reinforcement element to the building part.

Furthermore, the present invention relates to a part for thermal insulation between two building parts.

And finally the present invention relates to a method for connecting a reinforcement element to a building part, particularly a building ceiling to be made from on-site concrete.

In the field of above-ground construction it regularly occurs that a part, particularly cast in-situ from concrete such as a building ceiling or the like, is to be connected to another element, such as particularly a projecting part in the form of balconies, porches, etc., and here a first approach provides particularly to provide a number of bores into the cast part and subsequently to anchor the respective element in said bores. This method has proven, on the one hand, to be relatively expensive, particularly because the reinforcement elements of these parts must simultaneously be inserted in several bores.

Another approach provides suitably positioning the rod-shaped tensile reinforcement element to the building part already prior to casting the building part and then at least partially casting it together therewith during the production of the building part. This method allows the compensation of higher tensile forces, however here regularly a projection of at least portions of the respective tensile reinforcement element occurs, when the respective elements are provided for example at an outside of the building, thus considerably aggravating the erection of scaffolding, in particular, and sometimes even preventing it, for example in case of tight spatial conditions at the construction site.

Therefore there is a need for a solution that allows the subsequent fastening of tensile reinforcement elements, i.e. after the completion of the building part, without here the insertion of bores into the building part being necessary and/or without showing any projections in reference to the building part.

SUMMARY

The invention is based on the objective to further develop a molding arrangement of the type mentioned at the outset and/or a method of the type mentioned at the outset such that the subsequent fastening of a tensile reinforcement element at a cast building part is possible without inserting any bores and without any elements projecting from said part.

This objective is attained with a molding arrangement and a method having the features of the invention.

Another objective of the present invention comprises providing a building element for thermal insulation between two parts with integrated tensile reinforcement elements, which also allows the subsequent fastening of a tensile reinforcement element to the cast building part without inserting any bores and without any elements projecting from the building part.

This objective is attained with a building element having the features of the invention.

Beneficial further developments of the invention are explained below and in the claims, with their wording hereby being explicitly included in the description by way of reference, in order to avoid repetition of text.

According to the invention, a molding arrangement is provided to create a recess when casting a building part, particularly a building ceiling to be created from in-situ concrete, for connecting a rod-shaped tensile reinforcement element to the building part. The molding arrangement comprises at least one molding element to form the recess for the reinforcement element to be connected thereto as well as at least one anchoring element, and the anchoring element is embodied such that by said element a form-fitting connection can be created between the building part and a filler to be introduced in said recess that can be cured and/or bonded there.

A building element is provided according to the invention for thermal insulation between two building parts, namely between a supporting building part and a supported projecting exterior part, comprising an insulating body to be arranged between the two building parts having reinforcement elements passing through it, that can be connected to both building parts in the form of at least tensile reinforcement elements, using a molding arrangement as described and an anchoring element, and has the molding arrangement allocated for the tensile reinforcement elements at the side of the building part.

Finally, a method is provided according to the invention to connect a reinforcement element to a building part, particularly a building ceiling to be produced from in-situ concrete, includes the following processing steps:

a) separating an area matching the recess of the building part to be produced via a molding arrangement having a molding element and an anchoring element;
b) casting the building part outside the molding element,
c) arranging a reinforcement element to be connected to the building part in the area of the recess; and
d) inserting a filler into the recess that can be cured and/or bonded impinging the anchoring element to produce a form-fitting connection between the building part and the filler.

The tensile reinforcement element according to present invention relates particularly to tensile rods of an element of the type Isokorb® of the assignee. In order to subsequently connect it to the building part in a manner suitable to compensate tensile forces the molding arrangement according to the invention is used in order to create a recess during the casting of the building part, in which the tensile reinforcement element can subsequently be fixed by its free end allocated to the building part being inserted into the recess and by the recess then being filled with a filler that can cure and/or bond.

It is essential for the invention that the molding arrangement comprises not only a molding element to form the recess for the reinforcement element to be connected but also an anchoring element, which is embodied such that a form-fitting connection can be created thereby between the building part and the filler. This form-fitting connection ensures in an advantageous manner that the filler is suitable to transfer without restrictions the tensile forces transferred to it via the tensile reinforcement elements to the building part surrounding it. Without said form-fitting connection there would be the risk that the filler can be pulled out of the building part by the first tensile stress applied, thus that the tensile reinforcement element failed to ensure the objective of transmitting the tensile force allocated to it such that actually a transmission occurs of the tensile force between the building part, on the one hand, and the other building part to be connected to the tensile reinforcement element, on the other hand.

In this context it is particularly advantageous for the anchoring element to create the form-fitting connection between the building part and the filler to be introduced into the recess and curing and/or bonding at least partially projecting from the recess to be formed by the molding arrangement, thus the form-fitting (connection) is created directly in the area of the recess. With regards to the curing and/or bonding filler, this may comprise, e.g., a cement-containing and perhaps fiber-reinforced material, such as concrete, primarily high-strength or ultra high-strength mortar, or also a resin mixture, a reaction resin, or the like.

In this context it must be explained that the primary case of load in tensile force transmission comprises that the tensile reinforcement element is installed extending in the horizontal direction and that the tensile forces first impinge primarily in this horizontal direction, thus the form-fitting connection must accordingly be embodied such that it prevents such horizontal movement. Additionally, there is the risk in horizontally acting tensile forces, particularly when the respective moments are acting on the tensile reinforcement element and/or the building parts connected thereto, that the tensile reinforcement elements are lifted upwards, thus in the direction of the top of the building part. To this extent it is also necessary to prevent any vertical lifting of the filler from the recess. For this purpose it is therefore recommended that the anchoring element provides a form-fitting connection not only in the horizontal direction but also in the vertical direction, thus ensuring vertical safety.

In order to provide the anchoring element with the desired effects it is further beneficial that the anchoring element at least partially projects from the recess into the area of the building part surrounding the recess, thus that also a form-fitting connection is created at the side of the building part.

For this purpose, it is finally recommended that the anchoring element at least partially crosses the molding arrangement and thus extends from the side of the molding arrangement facing the recess to the side of the molding arrangement facing away from the recess.

Furthermore, it is essential for the molding arrangement according to the invention that the anchoring element is embodied as a dead anchoring element and for this purpose it is provided that after the creation of the recess via the molding arrangement it remains in the building part for good, in order to here form a form-fitting connection between the building part and the filler to be introduced into the recess. Only by the remaining of the anchoring element in the recess the form-fitting connection can be achieved to the filler and maintained until loading occurs.

Contrary thereto, it is particularly recommended with regards to the molding arrangement that after the recess was created and prior to connecting the reinforcement element it can be removed from the recess. This way, the filler, here particularly the concrete to be filled into the recess, can then impinge not only the anchoring element in a lasting, form-fitting manner but the filler here also contacts the building part directly, i.e. particularly the (bonded) in-situ concrete of the building part. This way, the molding arrangement no longer needs to be subjected to any conditions with regards to stability, permanence etc., rather it is sufficient for the molding arrangement that during the production of the building part, i.e. particularly during the casting of the in-situ concrete, the molding function is fulfilled and the recess is free from any material of the building part and then the molding arrangement can be removed. Here, it is irrelevant for the further function if the molding arrangement is destroyed during its removal or if it retains its original form and for this purpose perhaps is embodied in several parts, in order to prevent damaging the anchoring element remaining in the building part during removal.

For reasons of cost it is advantageous, of course, to embody the molding arrangement as simple as possible, and for this purpose it may be embodied like a bowl or a box, for example, and comprise plastic and/or metal. This may be embodied with a thin wall having the thickness of a film or sheet metal, preferably less than one millimeter and particularly only a few micrometers, so that overall the production costs remain very low. This means it is not required that the molding arrangement itself performs any load carrying function, except during the casting of the building part, thus it can be thin-walled and embodied optimized with regards to easier removability after the curing of the building part.

With regards to the removal of the molding arrangement, this depends of course on the installation conditions in the building part. In the exemplary embodiment, which is discernible from the attached drawing, the molding element is arranged in the building part essentially flush with its surface and face, in order to embody a recess adjacent to the surface and face of the building part. In this case, the reinforcement element to be connected to the recess extends in the horizontal direction from the recess through the face of the building part towards the outside. Here, the molding arrangement is embodied such that it can be removed in the direction of the upper side of the building part and/or in the direction of the intended progression of the reinforcement element to be connected.

With regards to the anchoring element, it is particularly advantageous when it is embodied as a reinforcement rod. Since reinforcement rods have not only proven and licensed material features with regards to the application in building parts comprising concrete, they also show the desired static capacities, since the purpose for use of the anchoring element is the form-fitting connection to the filler in the recess, which via the reinforcement element can further transfer any tensile forces impinged on the filler to the building part.

In a rod-shaped anchoring element in the form of a reinforcement rod the anchoring element can advantageously be embodied such that it serves as a joint anchoring element for two or more adjacent molding elements and/or arrangements and that for this purpose the joint anchoring element can be connected to two or more adjacent molding elements. This way, advantageously a mutual positioning is yielded of the anchoring element and the molding elements and/or molding arrangements so that a grid may be provided at the molding arrangements adjusted to the grid of the reinforcement rods to be installed.

This means that a grid is yielded comprising molding arrangement in the form of a continuous anchoring element made from a reinforcement rod and several molding arrangements connected thereto and that this grid can easily be used at the construction site to create the desired recesses in the building part and/or can be inserted in/on the molding of the building part. Here, for example this grid can be placed upon the building part reinforcement of the building part and only the position of the tensile reinforcement elements must be considered.

It is here particularly advantageous that a modular molding system is yielded, which can easily be adjusted to the most different installation and/or application conditions, such as the respective grid of reinforcement rods. Since the costs during the production of the molding elements are not very high, any change of their shape and size fails to lead to particular surcharges; and the possibility to change the mutual spacing of the molding element from each other via the anchoring elements in the form of reinforcement rods ensures a simplification of the components and thus a reduction in costs.

As mentioned above, the molding arrangement according to the invention can be used in a particularly advantageously manner such that it is used for thermal insulation in an otherwise commercial and/or known building element. For this purpose, the molding arrangement is allocated to the tensile elements of said building part for thermal insulation and provided at the side of the building part, with here several tensile elements may be allocated to a common molding arrangement, for example one molding arrangement to each tensile element or several molding elements to one joint anchoring element.

Due to the temporarily off-set installation of the building element for thermal insulation and the molding arrangement according to the invention the delivery to the construction site is not required to occur simultaneously, but is it also possible that the molding arrangement and the remainder of the building element for thermal insulation are delivered separately to the construction site, that first the molding arrangement is installed in the above-described manner and then after the creation of the recess and perhaps the removal of the molding element and/or the molding elements the remaining building element(s) for thermal insulation is positioned and installed.

The effect essential for the invention particularly develops when this temporarily off-set installation is measured in many days or weeks. Here, for example a building can be erected almost completely by allowing the above-mentioned recesses to remain and only then the tensile elements with the allocated building parts for thermal insulation are connected, namely beneficially when the projecting building parts to be connected to the building element for thermal insulation, for example concrete plates, are to be installed.

Here, it is possible to position the scaffolding during the construction of the building at the wall of the building, which is particularly important and may be beneficial in constricted conditions at the construction site. When the building has been erected, the connection of projecting building parts can then occur subsequently, and for this purpose perhaps either a new scaffolding with a greater distance is erected or perhaps the work can be done even with mobile lifts or cranes, with then the respective reinforcement elements to be connected being positioned in the recess and the filler being filled into the recess and this way the desired form-fitting connection being created between the reinforcement element, the filler, and the building part.

This applies equivalently for the installation of a building part for thermal installation with such a reinforcement element to be connected or even for the installation of a completely projecting building part, perhaps with a connected building element for thermal insulation and a respective reinforcement element to be connected. Here, it is essential that this subsequent assembly can occur in extremely short periods of time and thus the disturbance to the construction site and its environment can be reduced to a minimum.

Here, the construction elements for thermal insulation with the reinforcement elements and perhaps together with the attached projecting building parts may be simply assembled such that they are inserted into the recesses from above with their tensile force-reinforcement elements. Due to the excess size of the recess in reference to the reinforcement elements this requires no particular precision during the assembly, and even the subsequent alignment of the construction element in reference to the building part is without problems and easy due to the above-mentioned excess size, as long as the filler is not introduced into the recess.

The method according to the invention is primarily characterized in the described advantages, providing a respective decoupling of the assembly process of the processing step b) from the processing step c). In other words, the recess in the building part can be produced at any first period of time and the connection of the reinforcement element to this recess can occur at an arbitrary second point of time independent therefrom. Theoretically, this may be even used such that a building is provided with a large number of recesses and these recesses are only used when needed, while they could be sealed otherwise temporarily or for good, without the respective reinforcement element here mandatorily being arranged and/or connected.

However, the standard and particularly advantageous application the present invention is focused on comprises to provide the building with the above-mentioned recesses and at a later date to connect, if possible, several or all reinforcement elements, which leads to considerable synergy effects for the processes at the construction site and the assembly.

As already indicated, the molding element may be removed from the recess after the casting of the building part. This processing step e) may be performed beneficially between the processing steps b) and c).

BRIEF DESCRIPTION OF THE DRAWINGS

Additional features and advantages of the present invention are discernible from the following description of exemplary embodiments using the drawings. Shown here:

FIG. 1 is a perspective side view of a molding arrangement according to the invention;

FIG. 2 is a side view of the molding arrangement of FIG. 1;

FIG. 3 is a detail view of the molding arrangement of FIGS. 1 and 2;

FIG. 4 is a facing side view of a part of the molding arrangement according to the invention from FIGS. 1 through 3;

DETAILED DESCRIPTION OF THE PREFERRED EMBODIMENTS

Figure 5:
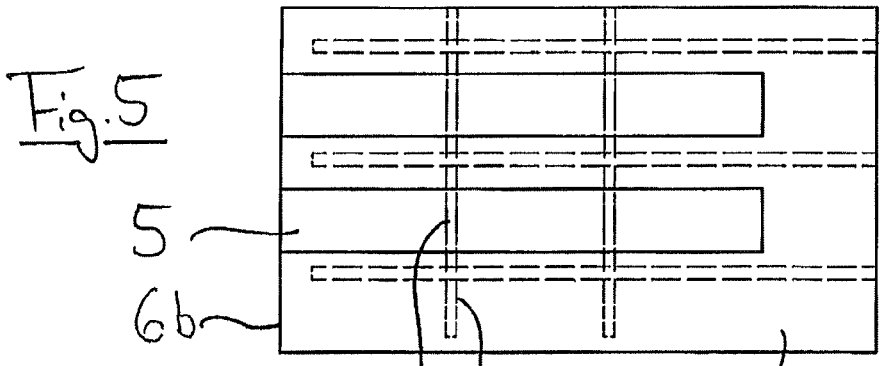
FIGS. 5 to 8 are views of the molding arrangement according to the invention from FIG. 1 in a state, combined with a construction element for thermal insulation and installed in a building part.

The molding arrangement 1 according to the invention, shown in FIG. 1, comprises several molding elements 2, arranged essentially in a horizontal direction parallel in reference to each other, which are made from a cup-shaped plastic, as well as rod-shaped anchoring elements 3, arranged perpendicularly in reference thereto and impinging the molding elements each in the area of their bottom. The molding arrangement 1 is shown in FIG. 1 in a position attached to a wall plate 4 for a building part (not shown) to be erected, as common for the installation case on a construction site, however said wall plate 4 is not a component of the molding arrangement of the present invention.

FIG. 2 and in detail particularly FIG. 3 show how the anchoring element 3, comprising a cylindrical reinforcement rod made from construction steel, cooperates with the molding elements 2. The two anchoring elements 3, extending parallel in reference to each other, penetrate the molding element in its lower area and thus, as discernible from FIG. 4, extent partially through the interior of the molding element and therefore show an interior area 3*a* and exterior areas 3*b* (see FIG. 4).

The molding element now serves to provide a recess in the building part (indicated by the reference character 5, which is equivalent to the interior of the molding element 2), limited by the wall plate 4. Thus, when the building part is produced by casting, the concrete of the building part contacts the molding elements 2, with here the desired recesses 5 remaining in this area.

For another application of these recesses, now either the molding elements 2 can be removed from the building part. Thus, in the exemplary embodiment shown in FIGS. 1 through 4 the molding elements would simply be pulled off towards the top, with here the anchoring elements 3, which are surrounded in the exterior areas 3*b* by the concrete of the building part, remain in said building part.

Figure 7:
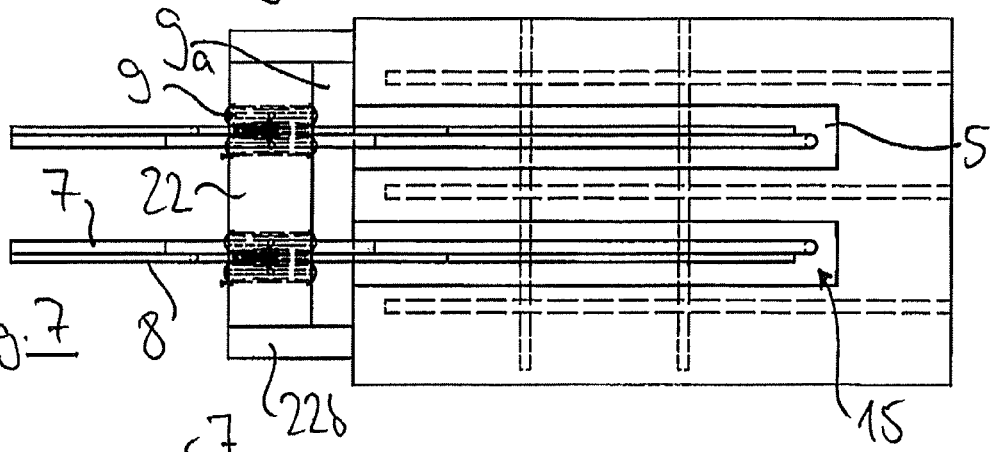
Figure 8:
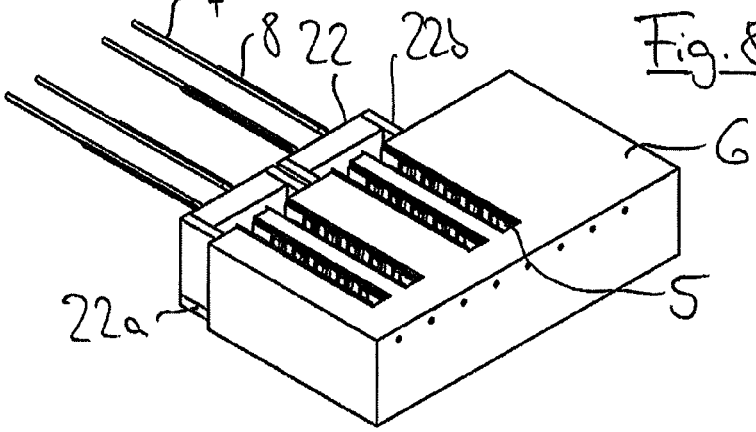
Figure 9:
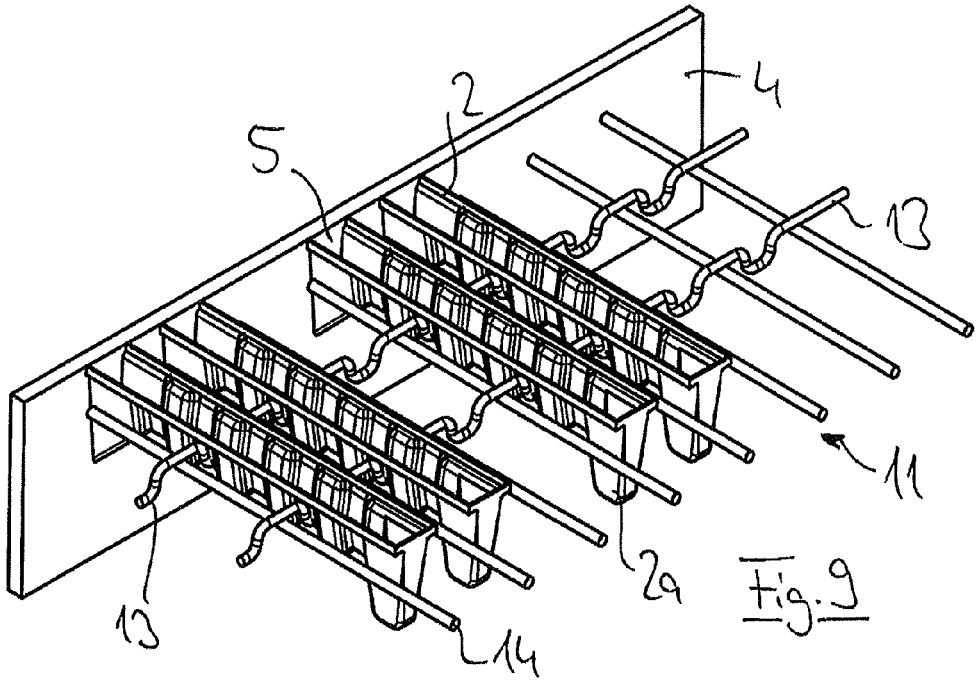
FIGS. 9 to 13 are views of an alternative embodiment of a molding arrangement according to the invention in a perspective side view (FIG. 9), in a side view (FIG. 10), in a detailed side view (FIG. 11), in a facial side view (FIG. 12), and in a vertical cross-section (FIG. 13).
Figure 10:
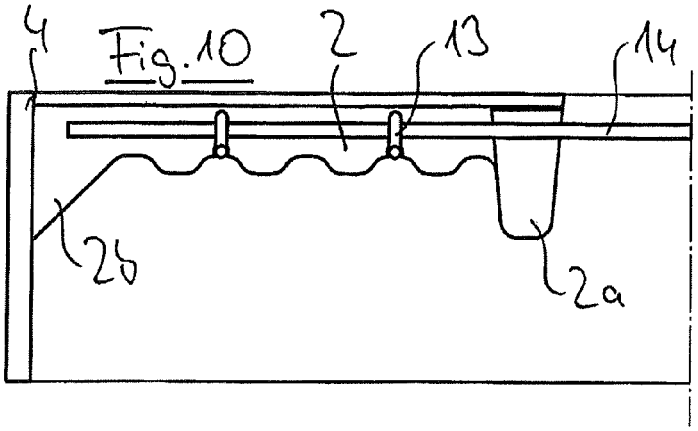
Figure 11:
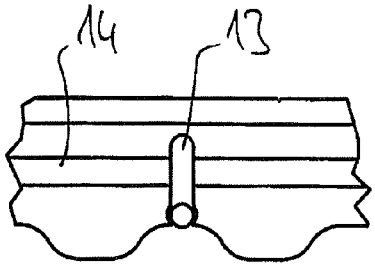

Regardless if the molding elements are or are not removed prior to further processing, the anchoring elements 3 with their interior areas 3*a* crossing the recesses 5 represent the essential area of the present invention, namely they form in this area form-fitting connections to a filler (not shown in these views and only indicated with the reference character 15 in FIG. 7), which is filled into the recesses 5. As primarily discernible from FIG. 3, the filler flows to the lower areas of the anchoring element 3 and encompasses it, and after curing in a form-fitting manner, any lifting of the filler 15 similar to pulling off the molding elements 2 is then no longer possible, because the filler cannot release this form-fitting connection without destruction.

In this context it shall be mentioned that it is also possible theoretically in case of anchoring elements 3 of the same position and molding elements 2 of the same position to guide the anchoring elements not through the molding elements but to provide respective recesses at the bottom of the molding elements, by which the molding elements completely cover the interior area 3*a* of the anchoring elements 3. In this case, a part of the molding element itself would form the form-fitting connection to the anchoring element created by the filler and only be supported by the anchoring element 3 at its outside. However, if the molding element was removed prior to filling in the filler, once more the same embodiment and functionality of the anchoring element was yielded as in the example shown in FIGS. 1 through 4.

It is also discernible from FIGS. 1 through 4 that the casting element overall shows an exterior form corrugated in the horizontal direction, which primarily serves to create a form-fitting engagement with the building part in the direction of the tensile force, i.e. horizontal in the direction of the wall plate 4. The corrugation of the molding element therefore exhibits the shape of ribs arranged parallel in reference to each other.

At the end of the molding element 2 at the side facing away from the wall plate 4 and/or the corresponding face of the building part an enlarged rib 2*a* is provided, which serves to compensate a respective bend of the reinforcement rod to be inserted into the recess 5. Such a bent reinforcement rod is advantageous in that it operates with an overall shortened length of the reinforcement rod embedded in the building part. For the rest, this bend also ensures another form-fitting connection between the reinforcement element, the filler, and the building part.

Additionally it is discernible, primarily from FIG. 4, that the molding element 2 shows an overall almost V-shaped exterior form in its vertical cross-section, by which the ribs also extend almost V-shaped, i.e. slightly deviating from the vertical. This conically sloped shape has the essential purpose to facilitate pulling off the molding element 2 from the building part and simultaneously allowing the continuous introduction of the filler into the recess 5.

An alternative embodiment of a molding arrangement 11 is shown in FIGS. 9 through 13, in which the molding elements are essentially embodied identical, and thus they are marked with the same reference characters. The essential difference is given in the form of the anchoring elements 13, which are not made from a cylindrical continuous reinforcement rod, as in FIG. 1, but are also embodied essentially in a corrugated form, namely slightly angled upwards in the respectively exterior area 13*b*, where they serve to be placed on a reinforced connection 14 for the building part and/or to cooperate with it. By this cooperation it is easily possible to arrange the molding arrangement 11 according to the invention in the precisely correct position in the building part (not yet filled with concrete) in order to then allow inserting reinforcement elements with the predetermined reinforcement grid into the recesses 5 created.

Figure 12:
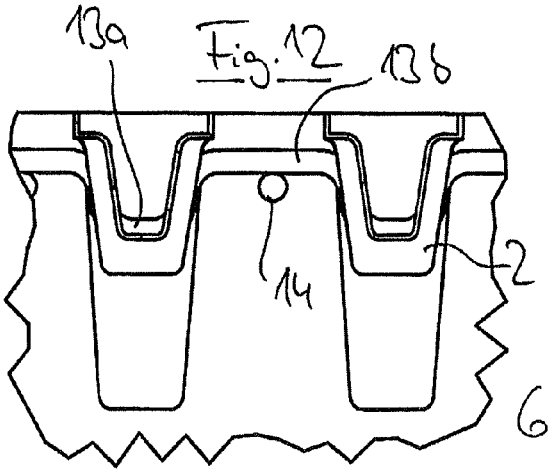
Figure 13:
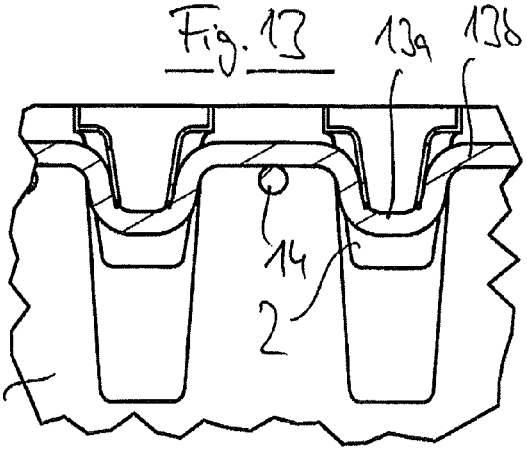

With regards to FIGS. 12 and 13 it must be mentioned that here too an interior area 13*a* of the anchoring elements 13 extends through the interior side of the molding elements 2 and exhibits respective exterior areas 13*b*, with from FIG. 13, having a vertical cross-section in the area of the anchoring elements 13, it being clearly discernible that the anchoring element 13 is guided through the wall of the molding element 2 and extends with its interior area 13*a* through the area of the recess 5.

Figure 6:
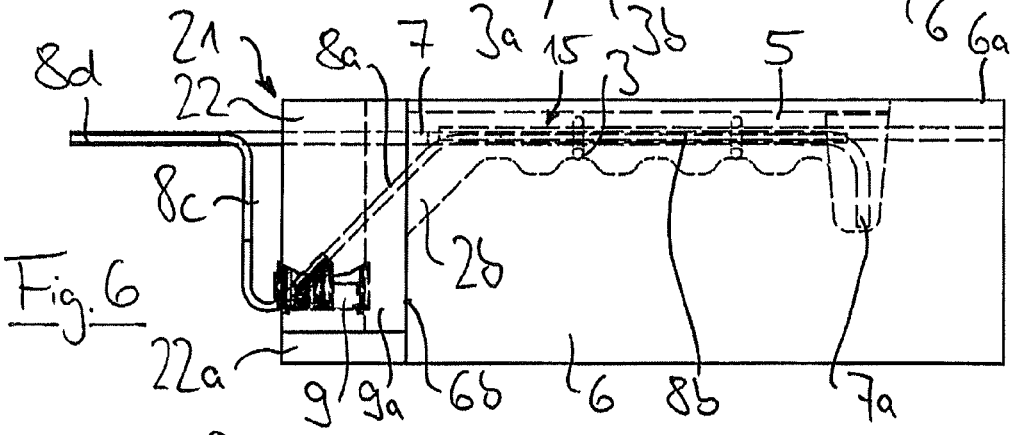

FIGS. 5 through 8 show the application of the molding arrangement according to the invention in the further progression: FIG. 6 shows a building part 6 in a vertical cross-section, in which adjacent to its top 6*a* and face 6*b* a recess 5 is provided, which, as clearly discernible, is equivalent to the form of the molding element 2, however in the exemplary embodiment shown the molding element has already been removed from the building part and only its corrugated form has been transferred to this surrounding building part. The anchoring elements 3 have remained in the building part, though, and extend with their interior area 3*a* through the recess 5, primarily discernible from FIG. 5. Due to the cylindrical form here undercut recess areas are provided, which ensure the desired form-fitting connection between the filler 15 to be filled into the recess and the building part 6.

A building element for thermal insulation 21 according to the invention is also connected to the building part 6, arranged between the building part 6 and a projecting exterior part in the form of a balcony base, not shown in the drawing, with the building part representing the carrying function and the exterior part the supported function. The building element for thermal insulation 21 comprises an insulating body 22, extending horizontally along the face 6*b* of the building part 6, and being embodied overall approximately block-shaped. Additionally the building element for thermal insulation 21 comprises reinforcement elements in the form of tensile reinforcement elements and/or tensile rods 7 and lateral reinforcement elements 8 as well as pressure reinforcement elements 9. The tensile reinforcement elements 7 extend horizontally through the insulating body in the upper tensile zone and here project at both sides of the insulating body 22 into the building part 6, on the one side, and into the exterior part to be arranged at the opposite side, with the tensile elements 7 at their free end inside the building component 6 essentially being angled downwards at a right angle into a short vertical section 7*a*, in order to this way reduce the overall embedded length of the tensile reinforcement rod 7 in the building part 6.

Here, the tensile reinforcement elements 7 extend according to the invention in the area of the recess 5 and are placed onto the anchoring elements 3, which facilitates the positioning of the building element for thermal insulation 21. Here, the recess 5 is sized sufficiently such that the tensile reinforcement elements 7 can be surrounded by sufficient filler material, as required for transferring the tensile force.

Lateral reinforcement rods 8 also extend into the recess 5, which inside the insulating body 22 extend parallel in reference to each other in vertical levels essentially sloped in reference to a section 8*a*, and which are bent for a connection to the building part 6 at their upper section 8*b* allocated to the building part 6 such that they project into the above-mentioned vertical levels essentially horizontally from said insulating body and extend through the recesses 5 in the horizontal direction adjacent to the tensile reinforcement rods 7. In the area of the supported exterior part, the lateral reinforcement rods 8 change to a vertical progression 8*c*, extend vertically to the upper tensile zone, and are here once more angled into a horizontal progression 8*d*, which aligns to the horizontal progression 8*b* at the side of the building part 6.

The pressure elements 9 arranged in the lower area of the insulating body essentially extend horizontally through the insulating body 22 and at their face each abut the building part 6, with a pressure plate 9*a* being interposed, on the one side and the exterior part, now shown, at the other side, with the facial contour of the pressure elements essentially showing a partially cylindrically curved and/or convexly curved area, known per se. At its bottom and sides the pressure plate 9*a* is surrounded by projections 22*a* and 22*b*, which serve as the mold for the production of pressure distribution plates cast from in-situ concrete.

In order for the lateral reinforcement rod 8 with its sloped progression 8*a* not colliding with the molding element and/or the material of the building part 6 the molding element is provided with an accordingly sloped bottom, which is discernible from FIGS. 1, 2, and 4 and is here marked with the reference character 2*b*.

From the drawing the progression of the process is easily discernible according to the steps a) through d), with perhaps the processing step e) being interposed. First the molding arrangement 1 with the molding elements 2 and the anchoring elements 3 is inserted into the building part to be created and for this purpose beneficially placed on the reinforcement of the building part (according to processing step a), this status is discernible from FIG. 1); subsequently the building part 6 is cast outside the molding element (according to processing step b), this status is for example discernible from FIG. 5); finally the reinforcement elements to be connected to the building part 6 in the form of tensile reinforcement elements 7 with a corresponding construction element for thermal insulation 21 are arranged in the area of the recess 5 (according to processing step c), this status is discernible from FIG. 6, 7, or 8); and finally (this is not shown except in FIG. 8) the filler 15, particularly concrete, is filled into the recess 5, impinging the anchoring element 3 (and/or its interior area 3*a*) to create the desired form-fitting connection between the building part 6 and the filler and/or the reinforcement element to be connected.

It is also apparent from the drawing that the status according to FIG. 5 can still be upheld easily for an extended period of time without any reinforcement elements being inserted, and that it is easily possible at some later time to place the reinforcement elements into the recess and insert the filler material.

Summarizing, the present invention shows the essential advantage that for the first time when erecting a building with projecting exterior parts, a modular assembly is permitted such that first the building is erected and/or "raised up" and that in a subsequent action taking only a brief period of time the projecting exterior parts are assembled with their reinforcement elements to the building part to be connected to, and for this purpose the reinforcement elements are placed in the recesses and the filler material is filled into the recess.

The invention claimed is:

1. A molding arrangement adapted to create a recess when casting a building part made in-situ from concrete adapted to connect a tensile reinforcement element to the building part, the molding arrangement comprises at least one molding element adapted to create the recess for the reinforcement element to be connected and at least one anchoring element, the at least one anchoring element is arranged in a bottom area of the at least one molding element which encompasses a lower area of the anchoring element, the molding element and the anchoring element being arranged such that the molding element and the anchoring element are adapted to create a form-fitting connection between the building part and a filler material that can be introduced into the recess and cured and/or bonded, and wherein the anchoring element is adapted to serve as a joint anchoring element for two or more adjacent molding elements and the joint anchoring element is connected to a plurality of the molding elements arranged adjacent to each other such that a distance of the molding elements is adjusted to the tensile reinforcement elements to be connected.

2. The molding arrangement according to claim 1, wherein the anchoring element for production of the form-fitting connection between the building part and the filler material to be introduced into the recess which can be cured and/or bonded, at least partially projects into the recess formed by the molding element.

3. The molding arrangement according to claim 2, wherein the anchoring element for the production of the form-fitting connection between the building part and the filler material to be introduced into the recess which can be cured and/or bonded is adapted to at least partially projects from at least one of the recess or the molding element into an area of the building part surrounding the recess.

4. The molding arrangement according to claim 1, wherein the anchoring element for the production of the form-fitting connection between the building part and the filler material to be introduced into the recess which can be cured and/or bonded at least partially crosses the molding element.

5. The molding arrangement according to claim 1, wherein the anchoring element is embodied as a dead anchoring element and after the recess has been created by the molding arrangement the anchoring element is adapted to remain in the building part in order to create a form-fitting connection between the building part and the filler material that can be introduced into the recess.

6. The molding arrangement according to claim 1, wherein the molding element is adapted to be removed in at least one of a direction of a top of the building part or a direction of an intended progression of the reinforcement element to be connected.

7. The molding arrangement according to claim 1, wherein the anchoring element is formed as a partial section of the molding element itself or connected to the molding arrangement in one piece.

8. The molding arrangement according to claim 1, wherein the anchoring element comprises a reinforcement rod.

9. The molding arrangement according to claim 1, wherein the molding element is bowl-shaped or box-shaped and is adapted to be arranged in the building part in an essentially flush fashion with a top and a face for a respective positioning of the recess adjacent to a top and a face of the building part.

10. The molding arrangement according to claim 1, wherein the molding element comprises at least one of a thin-walled plastic or metal.

11. The molding arrangement according to claim 1, wherein the filler material that can be cured and/or bonded comprises a cement-containing, a cement containing and fiber-reinforced material, a resin mixture, or a reacting resin material.

12. A building element adapted to create a thermal insulation between a supporting building part and a supported projecting exterior part, comprising an insulating body adapted to be arranged between the two building parts with reinforcement elements crossing between them, which can be connected to both building parts including at least tensile reinforcement elements, and a molding arrangement according to claim 1 allocated to the tensile reinforcement elements at a side of the building part.

13. The building element for thermal insulation according to claim 12, wherein a plurality of the tensile reinforcement elements are allocated to the joint molding arrangement.

14. The building element for thermal insulation according to claim 12, wherein the molding element is adjusted to a position, extension, and shape of the tensile reinforcement element allocated thereto and the molding element can be arranged at a distance from a position provided for the tensile element and extending in the building part at least approximately in an area of a tensile zone.

15. The molding arrangement according to claim 1, wherein the molding element being adapted to be removed after the creation of the recess and prior to the connection of the reinforcement element while leaving the anchoring element in at least one of the building part or the recess, with the lower area of the anchoring element adapted to be exposed so that it is adapted to be encompassed by the filler material.

* * * * *